United States Patent [19]

Hasson et al.

[11] Patent Number: 4,678,685

[45] Date of Patent: Jul. 7, 1987

[54] METHOD FOR RAPID CONTROLLED COATING OF THE INNER SURFACES OF PIPES WITH A TENACIOUS CALCITE LINING

[75] Inventors: David Hasson, Haifa; Mordechai Karmon, Petach-Tikva, both of Israel

[73] Assignees: Technion Research & Development Foundation, Ltd., Haifa; Mekoroth Water Co., Tel-Aviv, both of Israel

[21] Appl. No.: 775,036

[22] Filed: Sep. 11, 1985

[30] Foreign Application Priority Data

Oct. 9, 1984 [IL] Israel ..... 73198

[51] Int. Cl.[4] ..... B05D 7/22

[52] U.S. Cl. ..... 427/235; 427/237; 427/239; 427/240; 427/255.4; 427/343; 427/344; 427/345; 427/399; 427/419.2; 427/435

[58] Field of Search ..... 427/235, 237, 239, 255.4, 427/399, 419.2, 435, 345, 240, 343, 344

[56] References Cited

U.S. PATENT DOCUMENTS

| | | | |
|---|---|---|---|
| 686,672 | 11/1901 | Friswell | 427/345 |
| 2,064,776 | 12/1936 | Wilkinson et al. | 427/345 |
| 2,299,748 | 10/1942 | Hatch | 427/239 |
| 2,941,902 | 6/1960 | Talmey et al. | 427/345 |
| 3,640,759 | 2/1972 | Primus et al. | 427/239 |
| 4,096,061 | 6/1978 | Brennan | 427/345 |
| 4,162,217 | 7/1979 | Hermam | 427/345 |
| 4,165,401 | 8/1979 | Burke | 427/345 |
| 4,264,651 | 4/1981 | Hasson et al. | 427/239 |

OTHER PUBLICATIONS

Hasson, D. et al., "Process for Lining Water Mains by Controlled Calcite Deposition", papers presented at the International Conference on the Internal & External Protection of Pipes 5th publ. by BHRA Fluid Engineering, Cranfield, Bedford, England, pp. 153–167 (1983).

Peters, R. W. et al., "Effect of Iron as a Trace Impurity on the Water Softening Process" *The American Institute of Chemical Engineers,* No. 215, vol. 78, pp. 46–67.

*Primary Examiner*—Norman Morgenstern
*Assistant Examiner*—Janyce A. Bell
*Attorney, Agent, or Firm*—Browdy and Neimark

[57] ABSTRACT

The present invention relates to a method for obtaining a tenacious in-situ coating deposition of calcite on the inner surface of water pipes at very high rates. The calcite producing ingredients are supplied to the water stream in quantities supplementing concentrations available in the natural water used, giving the required supersaturation levels by addition of suitable salts to provide an aqueous lining solution supersaturated with respect to calcium carbonate containing dissolved calcium and carbonate ions. The method consists in maintaining the suspended calcium carbonate particles concentrations in the lining solution below 300 ppm, the excess suspended particles being removed by physical means. The calcite coating deposition according to the present invention has the advantage that it occurs at the rate of above 5 microns/h and even above 50 microns/h, maintaining a completely corrosion-free system during the coating. The method is applicable to lead pipes, cement mortar linings or asbestos pipes.

24 Claims, 1 Drawing Figure

Figure 1:
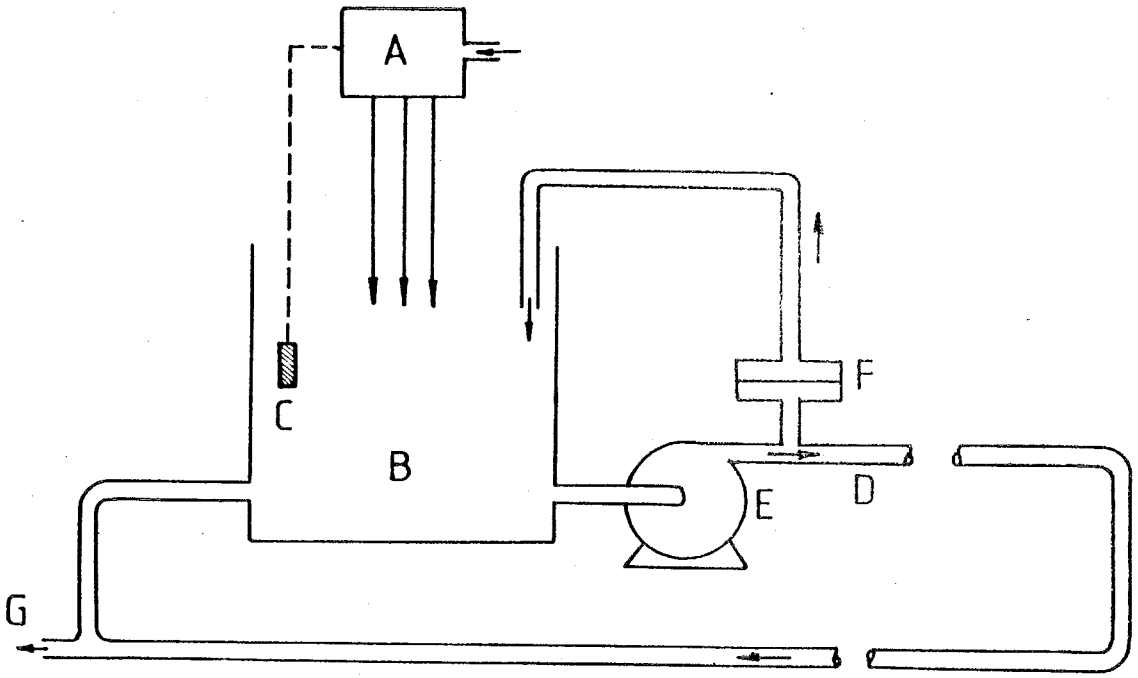

METHOD FOR RAPID CONTROLLED COATING OF THE INNER SURFACES OF PIPES WITH A TENACIOUS CALCITE LINING

FIELD OF INVENTION

The present invention relates generally to the inner protection of water supply pipes or mains against the attack of water by a protective lining. The invention provides an improved method enabling a relatively rapid controlled lining of the inner surfaces of pipes with a dense tenacious calcite lining.

PRIOR ART

All pipeline materials used in water distribution systems such as cast iron, steel and cement can be significantly attached by water. A widely encountered problem is the deterioration of unlined cast iron and steel water mains by internal corrosion processes. The accumulation of corrosion products on the pipe surface leads in time to several difficulties such as reduction in the pipe delivery capacity, augmented pumping costs, and debased water quality through rust coloration of the water. Water attack can also create difficulties with other piping materials. For example old lead pipes, which are still in service in many countries, can release lead compounds into the conveyed water at undesirably high concentrations from the health risk point of view. Similar concern has been voiced on the possibility of health risks from asbestos contamination of water conveyed in asbestos pipes.

The most widely preoccupying problem is the renovation of deteriorated old iron pipes. Restoration of such pipes is commonly practiced through two general operations—cleaning the pipes to remove the encrustation and applying a coating material, to provide a protective lining to the pipe material. Coating materials that have been used in such renovation operations include cement mortar lining, bituminous compositions and epoxy resins.

The present invention is in particular applicable to in-situ lining—without being limited thereto—of a pipe by a suitable calcium carbonate coating, denoted here by the term calcite and, therefore, some prior publications will be incorporated herein by reference. The economic and practical advantages of pipe rehabilitation inherent to calcite linings are described in the inventors' recent publication (D. Hasson and M. Karmon, Novel Process for Lining Water Mains by Controlled Calcite Deposition, Proc. 5th Intern. Conf. on Internal and External Protection of Pipes, Oct. 1983, Paper C5, pp 155–167, BHRA Fluid Eng., Cranfield, Bedford, England; also in: Corrosion Prevention and Control, 31 No. 2 (1984), 8–17.

The general background of the calcite lining method and the previous state of the art is described in the above mentioned paper and several other publications (R. F. McCauley, Journal AWWA, 52 (1960), 721–734; R. F. McCauley, Journal AWWA, 52 (1960), 1386–1396; R. F. McCauley, Water and Sewage Works, July 1960, 276–281; J. V. Radziul et al. Journal AWWA, 59 (1967), 1413–1426; N. S. Primus and R. Hunhoff, U.S. Pat. No. 3,640,759, Feb. 1972; D. Hasson and M. Karmon: U.S. Pat. No. 4,264,651; Israeli Pat. No. 55280). Briefly, the general method consists of passing through the cleaned pipe an aqueous solution supersaturated with respect to calcium carbonate at suitably controlled conditions. Supersaturation conditions are achieved by dosing usual water conditioning chemicals such as concentrated calcium chloride and sodium carbonate solutions, this operation being guided by well known equilibria principles of the calcium carbonate system. The aim of the lining operation is to deposit on the inner surface of the pipe as rapidly as possible a dense tenacious lining, well bonded to the inner pipe surface and of uniform texture. The crux of the calcite method lies in the ability to control the lining process so as to deposit linings of acceptable commercial quality (charaterized by the density of the lining, its adhesion strength and its uniformity), at a sufficiently rapid rate, with practical equipment and procedures compatible with the requirements of field work.

Crucial parameters that must be controlled in order to ensure the formation of commercially useful protective linings at acceptable rates include the surface conditions of the cleaned pipe, the flow velocity through the pipe and the composition of the lining solution. In order to obtain useful non-soft linings, it is imperative to maintain a sufficiently high velocity. It has been shown (D. Hasson and M. Karmon in the publication cited above) that the density and the quality of the lining improves with increasing velocity, the minimal velocity level required for a useful coating being about 1 to 1.5 m/sec. However, a high flow velocity promotes the corrosion process occurring on steel and iron pipe surfaces simultaneously with the calcium carbonate deposition process during the early stages of the lining, hinders adhesion of the lining to the pipe surface and negatively affects the quality of the deposit.

Our previous invention (U.S. Pat. No. 4,264,651 and corresponding Israeli Pat. No. 55280) describes a method for overcoming the above difficulty. Deoxygenation of the lining solution by addition of a reagent such as sodium sulfite prevents the occurrence of an interfering corrosion process and greatly improves the lining quality. Said invention also disclosed two further beneficial effects of the sulfite incorporation. Circulation of a sulfite solution above 100 ppm for a period above $\frac{1}{2}$ to 2 hours constitutes a simple surface conditioning method, enabling tenacious adhesion of the lining on the residual corroded layers of the cleaned pipe. Furthermore, the sulfite was discovered to have a useful inhibiting property, acting to reduce the undesirable process of bulk precipitation of calcium carbonate particles, whose deleterious effects are further discussed below.

A crucial requirement of the calcium carbonate lining method is in the maintenance of suitable chemical composition of the aqueous lining solution. A supersaturated solution of calcium carbonate flowing through a pipe tends to relieve its supersaturation by precipitation of calcium carbonate both in the bulk and on the flow surface. Bulk precipitation depletes the lining solution from dissolved calcium and carbonate ions and the useful lining process occurs at the residual calcium and carbonate levels. In our previous invention we have recommended control of the deoxygenated lining solution to give a residual dissolved calcium and carbonate levels each above 100 ppm (expressed as $CaCO_3$) and a precipitated particles concentration below the residual dissolved calcium or carbonate concentration, whichever is the smaller, preferably less than one half the concentration of the dissolved limiting reactant. We have observed that excessive particles concentrations are detrimental to the process.

In many lining situations, particularly when the main or pipe is of large diameter, it would be impractical to perform a once through lining operation in which the lining solution is discarded to waste after passage through the pipe. The lining process would have to be performed by recycling a large portion of the lining solution, discarding to waste only a small portion of the solution and suitably replenishing the system with added make-up fresh solution, as is common in recycle operations. As is well known from first principles, a recycling solution is retained for a longer time in the volume through which the solution flows. The significance of this increase in retention time is that more time is available for bulk precipitation of the particles, resulting in increased particles concentration and reduced residual levels of the dissolved calcium and carbonate ions usefully available for the lining process.

One way of ensuring that the lining solution is left with at least the minimal residual concentration levels of the dissolved calcium and carbonate ions and for confining the precipitated calcium carbonate particles to a low level so as to enable practical application of the lining process, is to dose the lining solution with suitable inhibitors, which retard bulk precipitation. The beneficial action of sulfite in this respect has been noted, but sulfite dosage alone may not be sufficient at high lining solution retention times, as impractically large concentrations would be required and undesirable side effects could be generated. It is necessary then to add reagents commonly used in water treatment which are sometimes loosely referred to as additives. Additives such as polyphosphates retard both the bulk precipitation and the wall crystallization processes of calcium carbonate but the retardation effect is more pronounced in the bulk. It is thus possible to maintain a sufficient residual supersaturation of the lining solution at the cost of some reduction in the speed of lining the pipe. Excessive additive dosage will be counterproductive, since the tendency for increased lining rate stemming from increased residual supersaturation will be countered by the enhanced inhibitory action of the additive on the lining rate.

A complementary action would be to increase the initial supersaturation level of the lining solution, through increase of dosage of the concentrated feed solutions creating the calcium carbonate supersaturation. From well known first principles, this operation would act to increase the residual supersaturation level of the calcium carbonate. However, most of the additional dosage would be found to end up as precipitated particles and the increased particle concentration could be markedly detrimental to the lining process to such a degree that the quality of the lining would be commercially unacceptable.

The above considerations show that under high recycle ratio conditions, typical of many lining situations, where retention times of the lining solutions may exceed two hours and reach even several hours, it is extremely difficult to produce dense linings (above 1.60 to 1.8 gr/cm$^3$), even with the incorporation of the above mentioned additional ingredients, at lining rates above 4 to 8 microns/hour. This limitation is of great economic significance, since the cost of the lining operation is mainly dictated by the time required to achieve a lining of a desired thickness. No less significant is the often imposed practical constraint that the water supply pipe or main can be made available for the lining operation only for a short restricted period. If, typically, a protective lining of at least 500 micron thickness is desired, a net lining time of over 60 to 120 hours would be required with lining rates of 4 to 8 microns/hr. Such long lining times may rule out, in certain cases, the feasibility of using the calcite lining process.

It is an object of the present invention to provide an economical method for lining the inner surfaces of pipes. It is another object of the present invention to provide an improved method for the controlled deposition of protective calcite linings on the inner surfaces of pipes. It is yet another object of the present invention to provide an improved method for enhancing both the quality of the lining and the lining rate. Thus the invention is comprised of a method for obtaining an improved deposition of calcite linings of above 50 micron thickness on the inner surfaces of pipes, said lining occurring at the rate of above 5 microns/h, being tenacious with bulk densities of above 1.5 gr/cm$^3$, the lining resulting by delivering through said pipes at a flow velocity of above 1 m/sec an aqueous lining solution supersaturated with respect to $CaCO_3$ containing dissolved calcium and carbonate ions each at a concentration level of above about 80 ppm (expressed as $CaCO_3$), maintaining substantially stoichiometric concentrations of the $CO_3^{--}$ and $Ca^{++}$ ions, said lining being produced by dosage of calcium and carbonate ions producing ingredients supplied in amounts providing initial supersaturations, corresponding to lining solution compositions that would be maintained in the absence of $CaCO_3$ precipitations at levels above 200 ppm $Ca^{+2}$ and above 200 ppm $CO_3^{-2}$, characterized by the fact that the suspended $CaCO_3$ particles concentrations in the lining solution is less than 300 ppm, the excess suspended particles being removed by physical means.

The most convenient physical means to remove the excess of suspended calcite particles is by filtration, although other means such as gravity sedimentation, centrifugation may be successfully utilized.

According to one variation, the carbonate ingredients are supplied through dosage of $CO_2$ and an alkaline reagent such as NaOH and/or lime. In this case, a most preferred embodiment is to inject all or part of the carbon dioxide to the filter, this producing a lowering of the pH and accordingly reducing the rate at which the filtration rate is diminished.

The term "calcite" adopted here refers to the predominantly calcium carbonate deposit formed on the pipe, which may include some impurities and may include other crystallographic species of calcium carbonate such as aragonite, vaterite etc.

The meaning of lining as utilized in the specification, covers in-situ or in factory lining or any other flow surface to be lined according to the present invention. The term flow surface includes configurations such as fittings, various objects placed inside the water conduit such that they are exposed to the flowing lining solution. A smaller diameter pipe placed in the center of a larger conduit, will of course be lined both in its inside and outside surfaces. Cement mortar linings, tar lined pipes, asbestos cement pipes, lead pipes and any other such pipes are flow surfaces that can be lined according to the present invention.

While the present invention is susceptible of embodiment in many forms, there is shown in the drawing and will herein be described in detail specific embodiments of the invention with the understanding that the present disclosures are to be considered as exemplifications of the principles of the invention and are not intended to limit the invention to the illustrated embodiments.

FIG. 1 shows a schematic drawing of the main components of a lining device utilizing the process of the present invention. By means of the dosage system (A), suitable chemical reagents capable to generate the calcite constituents are continuously metered at controlled rates to a feed vessel (B), with provision for pH control (C) of the solution, to produce an aqueous lining solution of suitable controlled composition, recycled through the lines pipe (D) by pump (E) to provide a flow velocity above 1 m/sec and preferably above 2 m/sec. Part of the lining solution is discarded to waste at (G), and precipitating particles are removed partially by filtration at (F).

In FIG. 1, dosage of all reagents is directed to the feed vessel without being limited thereto; if more convenient, it is possible to add the reagents at other suitable locations. The reagents may be dosed in several forms but the usual most convenient way is to feed the reagents (except $CO_2$) in the form of concentrated aqueous solutions.

When $CO_2$ is used, it can be conveniently bubbled through the lining solution, since this is alkaline and has good absorbing capabilities.

The reagents consist of water conditioning chemicals used extensively in water treatment practice. They are intended to provide the ingredients for crystallization of a calcium carbonate layer from a supersaturated lining solution having a controlled composition. References are available for safe prediction of the theoretical concentrations of the various species of the $CaCO_3$ system ($H^+$, $OH^-$, $H_2CO_3$, $HCO_3^-$, $CO_3^{-2}$, $Ca^{+2}$) that would be maintained in the lining solution in the complete absence of precipitation, which will be denoted, here, as initial supersaturation concentrations. (For example R. E. Loewenthal et al, Carbonate Chemistry of Aquatic Systems: Theory and Application, Ann Arbor Science Publ., Mich., 1976, D. T. Merrill et al, Corrosion Control by Deposition of calcium carbonate films—a handbook of practical Application and Instruction, AWWA Denver Colo., 1978).

There are many reagent possibilities for dosing the calcite producing ingredients to the lining solution. One common possibility for achieving a desired initial calcium ion supersaturation level is to dose a concentrated calcium chloride solution at a suitable rate. The desired initial supersaturation levels of the total alkalinity (due to bicarbonate and carbonate ions) and the carbonate alkalinity are achieved, for example, by dosing concentrated sodium carbonate and sodium bicarbonate solutions at suitable rates. To save the efforts of preparing concentrated sodium carbonate and sodium bicarbonate solutions, the same initial supersaturation levels of the total alkalinity and the carbonate ion could be obtained, for example, from a sodium hydroxide solution and gaseous carbon dioxide bubbled through the solution.

The initial supersaturation composition of the lining solution required for ensuring rapid lining rates above 10 microns/h depends on a combination of parameters. Under common conditions of a high recycle ratio characterized by a solution retention time above about two hours, use of sulfite as a deoxygenating agent, use of the condensed polyphosphate sodium hexametaphosphate ("Calgon"), use of a lining solution temperature between 20 to 45 degrees centigrade, use of a flow velocity above 1.5 m/sec, the initial calcium and carbonate concentrations are dosed to provide concentrations above 1000 ppm (as $CaCO_3$), the residual sulfite is maintained at about 100 to 400 ppm, and the polyphosphate is dosed at a rate maintaining a mass ratio of 200 to 500 parts of $Ca^{+2}$ (expressed as $CaCO_3$) to 1 part of polyphosphate. The residual measured calcium and carbonate concentrations under such conditions are commonly within the range of 80 to 300 ppm (expressed as $CaCO_3$), and the pH within the range of 9.0 to 10.5.

One of the key features of the present invention is the discovery that, under two nominally identical lining process conditions characterized by relatively initial high supersaturation conditions for promoting a rapid lining rate and differing only in the presence of precipitated particles in the one case and removal of most of the particles in the other case, there is a very marked increase in lining rate and lining quality in the case of the clarified lining solution. The lower the particles concentration, the higher the lining density produced. Dense commercial quality linings having a bulk density preferably above 1.8 gr/cm$^3$ to 2 gr/cm$^3$ are produced with particles concentrations below about 100 ppm, whereas with particles concentrations around 500 ppm the bulk density is below 1 gr/cm$^3$. For the particles concentrations of between 100 ppm to 500 ppm, corresponding decrease in bulk densities resulted.

Controlled clarification of the recirculating lining solution can be readily carried out by physical methods, although in principle chemical methods can be also envisaged. The simplest chemical method is dissolution of precipitated particles and subsequent neutralization. According to a preferred embodiment of the present invention, conventional solid-liquid separation equipment can be adapted for clarifying the lining solution. The equipment will be selected from known types of filters, centrifuges, thickeners or hydrocyclones. Physical separation of the particles will save the cost of chemicals and equipment required in the chemical method such as acid for dissolution and the subsequent neutralization of the excess acid.

The optimal conditions for crystallizing the lining at the most rapid rate are when the residual calcium and carbonate ions concentrations do not deviate excessively from each other. If the initial supersaturation conditions of the lining solution, characterized by the total alkalinity, carbonate alkalinity and dissolved calcium concentration, are controlled by dosage of the water conditioning reagents such that the calcium and carbonate concentrations are equal, then the residual calcium and carbonate concentrations, left in the lining solution after $CaCO_3$ precipitation, will remain essentially equal at all degrees of precipitation. While it is relatively simple to maintain substantially constant dosages of the various reactants with, for example, conventional metering pumps, it is practically impossible to prevent deviations between the initial calcium and carbonate concentrations without some control regulation such as residual carbonate concentration control by pH action. These deviations will cause a corresponding difference in the residual calcium and carbonate concentrations in the lining solution, and can lead to a lining rate much smaller than would have been possible, in the absence of the excessive concentration difference. It is straightforward for those skilled in water treatment practice to detect such deviations by conventional simple routine water analyses.

When the carbon species is supplied through gaseous $CO_2$, part or all the $CO_2$ is introduced close to the entrance or inside a physical separation device in which particles trapped in a filtering matrix increase the flow resistance. Maintaining low pH conditions was found to have a beneficial effect, expressed by a slower increase in the flow resistance.

The improved method according to the present invention can be applied over a wide range of temperatures of between 15 degrees to 60 degrees centigrade preferably in the range of 25 degrees to 45 degrees centigrade. Usually the lining solution temperature will be dictated by the existing ambient temperature and the energy input of the recycle pump which raises the temperature of the recycling solution. At lining solutions temperatures above 25 degrees centigrade the induction period required for bonding an initial calcite layer to the bare pipe surface will be short (about $\frac{1}{2}$ to $2\frac{1}{2}$ hours). At temperatures below 25 degrees centigrade, the induction period will become longer and will become excessively large under cold weather conditions. When the speed of the overall lining operation is of particular concern, it is simple to provide heating of the lining solution. A person skilled in the art will select the heating provision after evaluating the clear advantages of shorter lining time and improved lining quality obtained by carrying out the lining at temperatures higher than the ambient, versus the increased operational costs.

The present invention can be also successfully applied for calcite lining of a cement-lined or tar-lined pipes which show signs of deterioration such as cracks and loosened portions of the lining, shedding foreign material into the water. These linings can be restored using the calcite lining method according to the present invention which will save the high costs required for removal of the damaged lining and application of a new lining. In this case, a relatively thin layer of calcite will be sufficient to bond together the loosened material and seal the cracks.

The present invention can be also successfully applied for calcite lining of asbestos cement pipes and lead pipes respectively to relieve concern on possible health risks stemming from water exposed to asbestos cement and lead.

Referring to the experimental section, the rate of deposition of lining was followed by removing test specimens in a programmed manner and taking measurements such as increase in weight and thickness. The nature and quality of the lining could be qualitativly followed by visual inspection and simple scratch tests and more precisely by various techniques, including adhesion tests, chemical crystallographic and microscopic analyses, profilometric traces and density determinations. The lining obtained on the pipe itself could be also examined through the ports housing the test specimens.

The lining quality, using the method according to the present invention was measured by adhesion tests and density determinations, as these measurements give an indication on significant mechanical properties of the lining, such as its tenacity to the pipe and its porosity, that are considered of importance in protective coatings. For the more common application of utilizing calcite linings to protect from corrosion iron and steel pipes exposed to water free from aggressive $CO_2$, supplementary long duration corrosion tests data will be presented in the experimental part.

The adhesion measurement method used was the cross-cut adhesion test as described by British Standard 3900, Part E6 (1974). This test procedure is known for assessing the performance of a coating by measuring a property which depends on the adhesion of the coating to the substrate. There are six steps of classification based on visual examination of the appearance of a cross-cut area of the test coating. The highest grade of adhesion, marked 0, is achieved when the edges of the cuts area are completely smooth and none of the squares of the lattice is detached. The lowest grade is 5 and represents flaking that cannot be defined even by grade 4. Grade 4 is defined by some squares have been detached partly or wholly when a cross-cut area distinctly greater than 35% but not distinctly greater than 65% is affected.

While the invention has been described in connection with specific embodiments thereof, it will be understood that it is capable of further modification and this patent is intended to cover any variation, uses or adaptions of the invention following in general the principle of the invention and including such departures from the present disclosure as come within known or customary practice in the art to which the invention pertains and as may be applied to the essential features hereinbefore set forth and as fall within the scope of the invention. The following examples are given only for illustrating the invention without being limited thereto.

EXAMPLE 1

The experiments were carried out in a flow system of the type schematically shown in FIG. 1 consisting of a 2" diameter horizontal test pipe made of black iron of 13 m overall length. The pipe consisted of two sections connected by a flexible U connection. The pipe was provided with 10 equally removable tests specimens, consisting of segments cut from 2" pipes. Each segment was 15 cm long and 2 cm wide and was fitted to ports of similar cut at the upper face of the test pipe with an adequate sealing arrangement. The test specimens thus formed an integral part of the internal surface of the pipe. The lining solution fed from a cubic meter feed vessel was pumped by means of a circulation pump through the test pipe at a desired flow velocity and was returned to the feed vessel. A desired retention time of the lining solution in the system was obtained by means of level control of the feed vessel and the flow rate of fresh water and conditioning solutions fed to the feed vessel and the equivalent flow rate of lining solution withdrawn from the system and run to waste. Provisions were made to inject continuously the various conditioning solutions to the circulating lining solution by means of metering pumps. Bottled pressurized $CO_2$ gas was also available for injection to the system, when so desired. One of the metering pumps was actuated by a pH controller and used to feed sodium hydroxide to the feed vessel holding the sensing pH electrode. Filtration of bulk precipitated particles for clarifying the lining solution was achieved by pumping continuously part of lining solution through a battery of cartridge filters utilizing 3 to 25 micron cartridges. The temperature of the lining solution was controlled by means of thermostatically controlled electrical heaters immersed in the feed vessel.

The beneficial effect of particles removal can be illustrated by reference to results of two experiments (numbered here as experiments Nos. 1 and 2) carried out with substantially equal temperatures of the lining solution (35 to 40 degrees centigrade), identical retained solution volumes (450 liters), identical solution retention times (150 minutes), identical flow velocities through the pipe (2 m/sec), substantially similar residual sulfite concentrations (300 to 400 ppm), equal initial calgon feed concentrations (5 ppm) and substantially equal initial supersaturations (about 2000 ppm $Ca^{+2}$ and about 2000 ppm $CO_3^{-2}$) and lining solution pH (9.5). In one experiment (1), lasting 17 hours, in which the only mechanism for particles removal as by natural settling in the feed vessel, measured particles concentration suspended in the lining solution were between 250 to 400 ppm and residual $Ca^{+2}$ and $CO_3^{-3}$ concentrations in the lining solutions, measured during the run, were in the range of 150 to 250 ppm. The various tests specimens indicated adhesion numbers in the range of 1 to 2 while bulk densities of the lining was in the range of 1.3 to 1.6 gr/cm$^3$. The lining rate, estimated from weight difference measurements of the various test specimens was in the range of 1.1 to 1.5 mg deposited lining per square centimeter pipe surface per hour (corresponding to linear lining rates of about 7 to 10 micron per hour).

In the second experiment (2) lasting 18 hours, a flowrate of 25 to 35 liters/min of the lining solution was passed through the battery of cartridge filters. The residual $Ca^{+2}$ and $CO_3^{-2}$ concentrations in the lining solutions measured during the run were somewhat higher (200 to 300 ppm). The clarified lining solution contained only 20 to 40 ppm suspended $CaCO_3$ particles. The quality of the lining produced on the test specimens was noticeably improved compared with those of the first experiment (1). The adhesion numbers were in the range of 0 to 1 while the densities on the various test specimens were in the range of 2.0 to 2.3 gr/cm$^3$. The lining rates were also markedly improved, and rose to the range of 3.3 to 4.3 mg/cm$^2$ hr (corresponding to linear lining rates of 15 to 20 micron/hr). The induction period measured in both experiments was substantially similar, extending to about 1 to 1½ hours.

Further experiments revealed a clear trend of increased lining density with decreasing particles concentration and increased flow velocity.

EXAMPLE 2

To illustrate the preferred embodiment of injection of $CO_2$ to a filtering device service to separate precipitated particles, typical data will be first given for a cartridge filter flow performance under conditions of experiments numbers 2 and 3 described in Examples 1 and 2. A battery of 4 cartridge filters of 10" length and 5 micron nominal pore size, connected in parallel to a 1" piping system, fed with 25 to 40 liters/mm turbid lining solution at an available inlet pressure of 2 to 2.5 atmospheres gauge pressure completely clarifies the solution from its turbidity at a negligible pressure drop. The material accumulating in the filter consists of captured $CaCO_3$ particles as well as some $CaCO_3$ crystallizing on the cartridge filter through contact with the supersaturated solution. Usually a flow reduction due to increase flow resistance was noticed when about 150 to 250 grams of $CaCO_3$ accumulated in each cartridge and a flow of only a few liters per minute could be maintained at the above inlet pressure, necessitating change of the cartridges. The frequency of changing the filters is of practical importance in view of the considerably labor involved in replacing the filters and cleaning them. For conditions of experiments No. 2 and 3, the frequency of replacing the four cartridges can be every two to four hours. This can be a tedious operation in field operation and may dictate the use of excessively large equipment, to reduce the frequency of filter maintenance.

The improved performance of the cartridge filters through use of $CO_2$ to control the pH in the filter is illustrated from the results of experiment No. 4. In this experiment the carbon species required for creating carbonate supersaturation in excess of the comparatively negligibly small bicarbonate present in tap water was fed by bubbling $CO_2$ gas from bottled $CO_2$ cylinders and dosing NaOH through a pH controlled metering pump. The resulting supersaturation and lining conditions were essentially similar to those of experiments Nos. 1, 2 and 3. During the first part of the experiment, the $CO_2$ gas was bubbled at the entrance of the test pipe, where due to the existing high flow rate of the lining solution (about 250 liters/min) there was a negligibly small change in pH upon mixing of the $CO_2$ gas with an alkaline solution of pH of about 9.5. The flow rate of the filter was initially adjusted to 40 liters/min and after three hours decreased to about 12 liters/min. From the results of many previous experiments, the flow rate would have continued to decrease to a few litres per minute, causing the turbidity of the lining solution to increase to levels detrimental to the lining process because of insufficient removal of precipitated particles. At this stage, the $CO_2$ gas stream was diverted to the filter inlet and a pH of about 7.5 was measured at the filter inlet. With the carbon dioxide injection to the filter, the flow rate through the filter reversed its trend and increased in twelve hours from 12 liters/min to 20 liters/min. Visual inspection showed that the low pH environment had an effect on the filtered calcium carbonate cake, which appeared to be softer in comparison to the hard cake formed at high pH conditions. The clarification capability of the cartridge operated at low pH was retained throughout the experiment, as indicated by turbidity measurements.

EXAMPLE 4

An experiment as in Example 1, was carried out, using a flow velocity through the pipe of 2.8 m/sec, the purpose being to demonstrate the ability to increase the rate of lining deposition to very high values. In this case, the reagents introduced at constant rates were: $CaCl_2$ (initial supersaturation corresponding to 8000 ppm as $CaCO_3$) NaOH solution (initial supersaturation corresponding to 8200 ppm as $CaCO_3$), sulfate dosage (residual level of about 200 ppm as $Na_2SO_4$) and 30 ppm Calgon. Part of the $CO_2$ was fed to the filter (operating at a flow rate of 30 l/min) with four 10 inch-cartridge filters of 10 microns, maintaining a pH of about 7.5 at the filter inlet. The pH of the controller instrument was adjusted to 9.4, this value being maintained by a pH controlled feed of $CO_2$. The average residual $Ca^{++}$ and $CO_3^{--}$ values in the lining solution, were around 250 ppm calcium carbonate each. The particles concentrations in the lining solution were 20 ppm as calcium carbonate. Under these operating conditions, the filtration capacity was substantially constant with very slow decrease of flowrate. After 5 hours of operation it was found that an excellent coating (density of 2.2–2.4 g/cm$^3$) was obtained with a thickness of 300–400 u, which corresponds to a lining rate of 60–80 u/hr.

EXAMPLE 5

To illustrate the corrosion protective capability of calcite linings produced according to the present invention on iron and steel surfaces, some results of a long duration corrosion test will be illustrated. Linings of various thickness formed on iron specimens were exposed to flowing water of controlled composition for a period of 130 days. The water had a Langelier saturation index in the range of −0.05 to +0.1. The corrosive tendency of tap water was promoted by dosing it with NaCl, giving concentrations of 3 to 7 gr/liter NaCl (conductivity of 10 to 15 millimho/cm) and maintaining a water temperature of 35 to 40 degrees centigrade. The unlined blank specimens of iron were markedly corroded, developing about 7 pits per sq.cm. Some of the lined specimens having lining thicknesses below 400 micron developed 1 to 2 pits per sq.cm. No pitting at all developed in all specimens having a lining thickness of above 500 microns.

We claim:

1. A method for obtaining a tenacious in situ coating deposition of calcite having a thickness of above 50 microns on the inner surface of pipes, the lining being deposited at a rate of at least 5 microns/hour, the lining having a bulk density of at least 1.5 gram/$cm^3$, by delivering through said pipes at a flow velocity of above 1 m/sec. an aqueous lining solution supersaturated with respect to calcium carbonate containing dissolved calcium and carbonate ions each at a concentration level of above about 80 ppm expressed as $CaCO_3$, comprising maintaining substantially stoichiometric concentrations of the $CO_3^{-2}$ and $Ca^{+2}$ ions, wherein the concentration of suspended CaCO3 particles is less than 50 ppm, and the excess suspended particles generated in the system are removed by physical particle removal means.

2. A method according to claim 1, wherein the suspended $CaCO_3$ particles concentration in the lining solution is less than 150 ppm.

3. A method according to claim 1, wherein the excess of suspended particles are removed by filtration equipment.

4. A method according to claim 1, wherein the excess of suspended $CaCO_3$ particles are removed by gravity sedimentation in a holding vessel.

5. A method according to claim 1, wherein the excess of suspended particles are removed by clarifying or filtration centrifuges.

6. A method according to claim 1 wherein the calcium carbonate producing ingredients of the lining solution are formed from a calcium ion forming member selected from the group consisting of a soluble calcium salt, dissolved $Ca(OH)_2$ and mixtures thereof; and a carbonate ion forming member selected from the group consisting of a soluble carbonate salt, a soluble bicarbonate salt, the combination of an alkali metal and carbon dioxide gas, and mixtures thereof; wherein the carbonate producing ingredients provide initial controlled calcium and carbonate concentrations which are roughly equal and provide substantially equal residual calcium and carbonate concentrations.

7. A method according to claim 6, wherein the calcium carbonate producing ingredients of the lining solution are $CaCl_2$, $CO_2$ and NaOH.

8. A method according to claim 6, where the calcium carbonate producing ingredients of the lining solution are $CaCl_2$, $Na_2CO_3$, $NaHCO_3$ and NaOH.

9. A method according to claim 6, where the calcium carbonate producing ingredients of the lining solution are $CO_2$ and $Ca(OH)_2$.

10. A method according to claim 6, wherein the calcium carbonate producing ingredients are added to the lining solution as streams of concentrated reagents.

11. A method according to claim 1, where the flow rate of the lining solution is above 2.0 m/sec.

12. A method according to claim 1, where the initial supersaturation conditions are above 1500 ppm calcium and above 1500 ppm carbonate.

13. A method according to claim 1, wherein the lining is carried out at temperatures up to 80 degrees centigrade.

14. A method according to claim 13, wherein the lining is carried at a temperature in the range of 20 degrees to 60 degrees centigrade.

15. A method according to claim 1, applied to the internal surfaces of iron and steel pipes.

16. A method according to claim 15, wherein alkali metal sulfite in amounts above 100 ppm are incorporated into the lining solution circulated during calcite lining.

17. A method according to claim 1, wherein additives for water treatment are incorporated in the lining solution circulated during calcite lining.

18. A method according to claim 17, wherein said additives are selected from the group consisting of sodium phosphates and alkali polyphosphates.

19. A method according to claim 1, wherein small amounts of silicates are also incorporated into the lining solution circulated during calcite lining.

20. A method according to claim 6, wherein said carbonate ion forming member is a combination of an alkali metal and carbon dioxide gas and wherein part or all of the $CO_2$ is injected at the entrance of or inside said particle removal means, to lower the pH at which lining solution clarification is made, the lowered pH being maintained below pH 8.5.

21. A method according to claim 1 wherein the pipes being treated are made of lead.

22. A method according to claim 1 wherein the pipes being treated have a lining made of cement mortar.

23. A method according to claim 1 wherein the pipes being treated are made of asbestos.

24. A method according to claim 20, wherein said particle removal means comprises filtration equipment.

* * * * *